United States Patent [19]

Wickl

[11] 4,368,758

[45] Jan. 18, 1983

[54] DEVICE FOR CONTROLLING A STEAM OR GAS TURBINE

[75] Inventor: Rudolf Wickl, Wesel, Fed. Rep. of Germany

[73] Assignee: Siemens Aktiengesellschaft, Munich, Fed. Rep. of Germany

[21] Appl. No.: 184,464

[22] Filed: Sep. 5, 1980

[30] Foreign Application Priority Data

Sep. 25, 1979 [DE] Fed. Rep. of Germany ..... 2938763

[51] Int. Cl.[3] ..... F16K 1/00

[52] U.S. Cl. ..... 137/601; 251/357

[58] Field of Search ..... 137/533.21, 601; 251/356, 357

[56] References Cited

U.S. PATENT DOCUMENTS

| | | | |
|---|---|---|---|
| 229,881 | 7/1880 | Gaskill | 137/533.21 |
| 322,889 | 7/1885 | Austin et al. | 137/533.21 |
| 821,758 | 5/1906 | Smith | 251/357 |
| 1,002,938 | 9/1911 | Stonge | 251/357 |
| 2,261,885 | 11/1941 | Kowacz | 137/533.21 |
| 2,912,002 | 11/1959 | Miller | 251/357 |
| 3,625,241 | 12/1971 | Shields | 137/601 |

FOREIGN PATENT DOCUMENTS 760185 1/1953 Fed. Rep. of Germany .

*Primary Examiner*—A. Michael Chambers
*Attorney, Agent, or Firm*—Kenyon & Kenyon

[57] ABSTRACT

In a device for controlling a steam or gas turbine, including a valve beam for actuating at least two control valves, the valve cones of which are hung by lifting heads at the end of their valve stems resting on seats in the valve beam, the danger of breakage is reduced by making the valve stem with an integral lifting head and screwing it into female threads in the valve cone, the valve cone having on its side facing the lifting head an integral nut neck, at least in the region of the first screw threads.

5 Claims, 3 Drawing Figures

DEVICE FOR CONTROLLING A STEAM OR GAS TURBINE

BACKGROUND OF THE INVENTION

This invention relates to turbines in general and more particularly to an improved device for controlling a steam or gas turbine.

A device for controlling a steam or gas turbine, including a valve beam for actuating at least two control valves, the valve cones of which are hung by their valve stems in the valve beam and are held by lifting heads, is described in German Pat. No. 760 185. The valve beam is provided with holes in which the valve stems of two or more control valves slide. In this design, the valve stems are held by lifting heads in the form of nuts. To open the control valves, the valve beam located above is lifted, for instance, by a lever linkage and a servo motor. The control valve with the lowest lifting head opens first, then the one with the next higher lifting head, etc. until all control valves are open. For closing the control valves, the valve beam is lowered whereby the steam or gas pressure present pushes the individual valve cones tightly onto the corresponding valve seats as soon as the seats are reached.

In the known device the pulsating forces acting on the valve cones are transmitted to the valve beam via the valve stems and the lifting heads in the form of nuts, and, in the screw connections between the valve stems and the lifting heads, the forces are deflected by an angle of 180°. Due to this deflection of the forces, the fatigue stength of the screw connections is extremely low, so that breaks frequently occur in the region of the first load carrying thread of the valve stems.

In another known device for controlling a steam or gas turbine, a split valve beam is provided so that the control valves with valve cone, valve stem and lifting head can be made in one piece. This design with the lifting head integrally formed in the valve stem has the advantage that the weakening by a screw connection is eliminated, but splitting of the valve beam must be tolerated instead.

It is therefore an object of the present invention to provide a device for controlling a steam or gas turbine, in which, on the one hand, the fatigue strength at the lifting heads is increased and in which, on the other hand, the valve beam can be constructed without being split.

SUMMARY OF THE INVENTION

According to the present invention, this problem is solved by providing, in a device of the kind mentioned at the outset, a valve stem for a control valve which has an integral lifting head. The valve stem is screwed into a female thread in the valve cone, with the valve cone having a nut neck on its side facing the lifting head, at least in the vicinity of the first threads.

Because the lifting head is integrally formed with the valve stem, the weakening by a screw connection at the connecting point is eliminated. Due to the screw connection between the valve stem and valve cone, an introduction of the valve stems into the corresponding holes of the valve beam is made possible, on the other hand, so that the valve beam can be made in one piece, i.e., without being split. However, merely relocating the screw connection from the lifting head to the valve cone does not in itself eliminate the danger of breakage. This only shifts the likely points of facture. Therefore, as a further measure, the valve cone is equipped, on its side facing the lifting head, with an integral nut neck, at least in the vicinity of the first thread. Thereby, the same advantages are obtained as with a neck nut. At least the first threads are utilized in the neck stressed in tension to cooperate in the transmission of the force, so that the threads in the valve stem and in the nut neck are deformed similarly. Through the elastic elongation of the nut neck, an advantageous load distribution is obtained in the transmission of the forces from the valve cone into the valve stem, whereby the danger of breakage in the vicinity of the screw connection can largely be eliminated.

In one preferred embodiment of the device according to the present invention, the neck of the nut extends over the entire load carrying portion of the female thread. This results in the same advantages as with a tension nut. The entire load carrying region of the nut thread is stressed almost exclusively in tension, so that an even more favorable transmission of the forces from the valve cone into the valve stem is obtained without further increase of the fatigue strength. If the valve cone is designed so that the nut neck is tapered toward the first screw thread, the forces acting on the valve cone can be distributed completely uniformly over all screw threads, as with a nut of uniform strength, i.e., an optimal distribution of the forces to be transmitted by the screw connection is obtained.

The female thread is preferably cut into a blind hole in the valve cone. This makes it possible to support the valve stem at the bottom of the blind hole in order to obtain a pretension of the thread of the screw connection.

For the durability of the screw connection it is also of advantage if the cross section of the valve stem in the region following its screw thread is equal to the core cross section of the screw thread.

If a fillet is provided at the transition between the lifting head and the valve stem, the danger of a breakage in the transition region is reduced still further.

It is also of advantage to make the seat of the lifting head in the valve beam conical. Since the valve stems are guided in the valve beam with play, the conical seat has a centering effect and aligns the valve cones with respect to the corresponding valve seats.

In a further embodiment of the device according to the present invention the lifting head sits in a hollow cylindrical insert on the valve beam. Such an insert can be made of a material more wear-resistant than that of the valve beam and can also be replaced easily if needed.

DETAILED DESCRIPTION OF THE INVENTION

Figure 1:
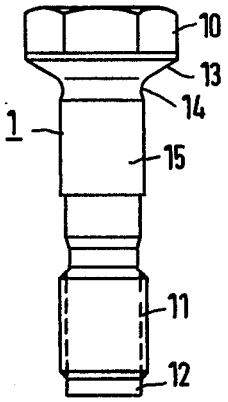
FIG. 1 shows a valve stem with an integral lifting head and a screw thread.
Figure 2:
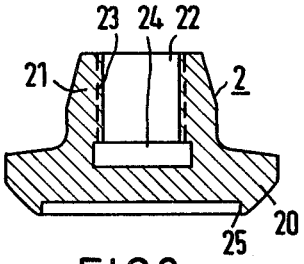
FIG. 2 is a cross-sectional view of a valve cone with a female thread.

FIG. 1 shows a valve stem 1 which has an integral lifting head 10 at its upper end and a screw thread 11 and a core extension following thereon at its lower end. The cross section of the stem 1 in the region following the screw thread is equal to the core cross section of the screw thread. The lifting head 10 is a hexagon head and is provided with a conical contact surface 13 which merges via a fillet 14 into a cylindrical stem region 15. FIG. 2 shows a valve cone 2 which consists of a closing part 20 essentially in the shape of a truncated cone, and a nut neck 21 formed thereon. In the region of the nut neck 21, a blind hole 22 with a female thread 23 and a thread groove 24 at the end of the thread is made in the valve cone 2.

The nut neck 21 is tapered in its upper region toward the first screw thread of the female thread 23, so that all screw threads of the female thread 23 can be utilized uniformly for carrying the load, as with a nut of uniform strength. On the underside of the valve cone 2 the closing part 20 has a circular cut-back, between the edge of which and the conical surface a breaking edge 25 is formed.

Figure 3:
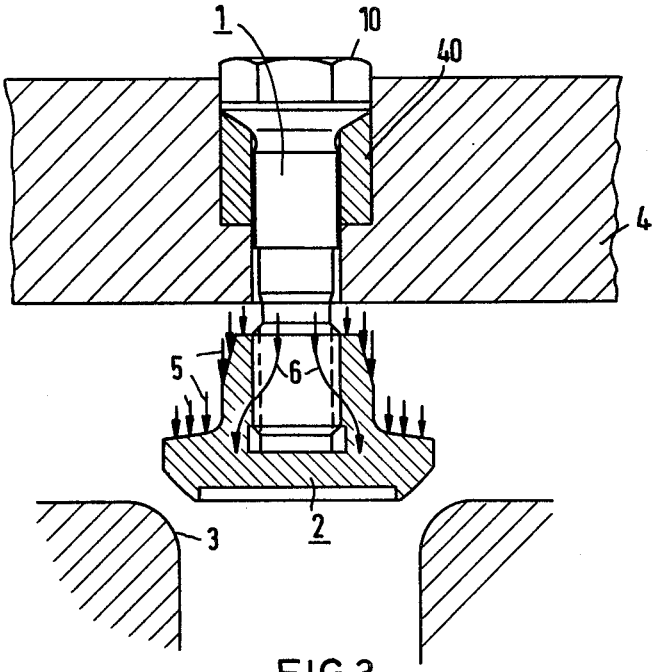
FIG. 3 is a longitudinal section through a valve beam in the vicinity of a control valve according to the present invention.

FIG. 3 shows a cross section through a control valve which consists of the valve stem 1 (FIG. 1), the valve cone 2 (FIG. 2) screwed thereon, and the corresponding valve seat 3. The valve stem 1 is hung in a valve beam 4, the conical contact surface 13 (FIG. 1) of the lifting head 10 resting on a seat surface of corresponding shape of a hollow cylindrical insert 40 inserted into the valve beam 4. The outside diameter of the insert 40 is chosen so that the vavle stem 1 can slide in the valve beam 4 with play. The opening and closing of the control valve is accomplished by lifting or lowering the valve beam 4, where the sequence of the opening or closing is determined by the length of the valve stem 1, in comparison with further control valves hung in the valve beam 4.

The static pressure forces acting on the valve cone 2 are indicated in FIG. 3 by arrows 5. Overall, pulsating forces act on the valve stem 1 which correspond to the product of the valve area and the pulsating pressure difference. Since the share of the nut neck 21 (FIG. 2) in the total valve area is relatively small, the thread is stressed exclusively only in tension. Therefore, the same advantageous shape is obtained by the transmission of the forces indicated by arrows 6 as with a tension nut.

What is claimed is:

1. In a device for controlling a steam or gas turbine, including a valve beam for actuating at least two control valves, the valve cones of which are hung by lifting heads at the ends of their valve stems resting on seats in the valve beam, the seats in the valve beam having conical shape, the improvement comprising:

(a) each valve stem including an integral lifting head at one end and a male thread at the other;

(b) each valve cone having a blind hole containing female threads, said stems screwed into said female threads of the valve cones; and (c) each valve cone having, on its side facing the lifting head, an integral nut neck of conical shape, tapered toward the lifting head, which extends over the supporting area of said female screw threads.

2. The improvement according to claim 1, wherein the cross section of the valve stem in the region following its screw thread is equal to the core cross section of the screw thread.

3. The improvement according to claim 1 and further including a fillet at the transition between the valve stem and the lifting head.

4. The improvement according to claim 1 and further including a hollow cylindrical insert in the valve beam, in which said lifting head is disposed.

5. The improvement according to claim 1, wherein said stems are screwed into the female threads of said valve holes into abutment with the base of said blind hole to thereby pretension the screw connection between said valve cone and valve stem.

* * * * *